US007334446B1

(12) United States Patent
Bauder

(10) Patent No.: US 7,334,446 B1
(45) Date of Patent: Feb. 26, 2008

(54) METHOD FOR PRODUCING A STRIPLIKE PRE-MATERIAL MADE OF METAL, ESPECIALLY A PRE-MATERIAL WHICH HAS BEEN PROFILED INTO REGULARLY REOCCURRING SECTIONS, AND DEVICE THEREFOR

(76) Inventor: Hans-Jörg Bauder, Hauptmannstrasse 35, 75417 Mühlacker (DE)

( * ) Notice: Subject to any disclaimer, the term of this patent is extended or adjusted under 35 U.S.C. 154(b) by 0 days.

(21) Appl. No.: 10/030,328

(22) PCT Filed: May 11, 2000

(86) PCT No.: PCT/EP00/04269

§ 371 (c)(1),
(2), (4) Date: Nov. 9, 2001

(87) PCT Pub. No.: WO00/69582

PCT Pub. Date: Nov. 23, 2000

(51) Int. Cl.
*B21B 21/00* (2006.01)

(52) U.S. Cl. ..... 72/197; 72/187; 72/188; 72/189; 72/198; 72/252.5; 72/229

(58) Field of Classification Search ..... 72/188, 72/189, 197, 198, 246, 252.5, 229; 492/38, 492/30
See application file for complete search history.

(56) References Cited

U.S. PATENT DOCUMENTS

| | | | | |
|---|---|---|---|---|
| 136,620 | A * | 3/1873 | Richardson | 72/188 |
| 224,720 | A * | 2/1880 | Parr | 72/188 |
| 238,953 | A * | 3/1881 | Nicols | 72/189 |
| 1,655,866 | A * | 1/1928 | Baehr | 40/480 |
| 3,896,653 | A * | 7/1975 | Sakai et al. | 72/200 |
| 4,257,251 | A * | 3/1981 | Jury | 72/57 |
| 4,608,850 | A * | 9/1986 | Ballantyne et al. | 72/240 |
| 4,793,169 | A * | 12/1988 | Ginzburg | 72/240 |

FOREIGN PATENT DOCUMENTS

JP 60037201 A * 2/1985

* cited by examiner

*Primary Examiner*—Dmitry Suhol

(57) ABSTRACT

This invention describes both a method and apparatus to practice a method which produces a strip-like pre-material from metal using rollers which have a roll gap in which the metal strip is discontinuously rolled in successively steps between the same two rollers with the metal strip being also recalled, but the recalled section of the metal strip is shorter than the circumference of the rollers. In this manner the surface quality of the metal is improved, especially relating to stamping of coins and metals.

63 Claims, 9 Drawing Sheets

METHOD FOR PRODUCING A STRIPLIKE PRE-MATERIAL MADE OF METAL, ESPECIALLY A PRE-MATERIAL WHICH HAS BEEN PROFILED INTO REGULARLY REOCCURRING SECTIONS, AND DEVICE THEREFOR

SPECIFICATION

This invention relates to a method having the features defined in the preamble of Claim 1. A method of this kind has been known for DE 195 04 711 C2. In practical operation, a metal strip is repeatedly rolled, running continuously from its beginning to its end through a roll stand, the working direction of which is then reversed so that thereafter the metal strip is run through the roll stand once again over its full length, but now in reverse direction.

From DE-PS 104 875 it has been known to profile strip-shaped or plate-shaped workpieces by a single-step rolling process, for the production of tubes. A similar method is disclosed by DE 197 04 300 A1 for the production of profiled blanks, especially of car body sheets.

A reciprocating rolling method for the production of thin strips from a thick starting material is described in DE-PS 638 195. In the case of this method, the starting material is shaped step by step with a high degree of deformation, being passed through the roll gap in reverse direction to the usual rolling direction.

From U.S. Pat. No, 1,106,172 it has been known to convert a strip-like material continuously to profiles using an arrangement of three roll stands arranged one behind the other.

The value of coins and medals for collectors rises with their surface quality. The stamping of coins and medals starts out from proofs, i.e. coin blanks and medal blanks, which already have a high-polish surface. Proofs are stamped from a strip-like pre-material. The strip-like pre-material is produced from a pre-material of a few mm, for example 10 mm, thickness. This material is rolled in several passes to a strip of, for example, 0.5 mm to 2 mm thickness. Such a strip, the thickness of which is determined by the coins and medals to be stamped, is used as pre-material from which the proofs are stamped. Conventionally, the two rollers are exchanged before the last pass against a pair of rollers with high-mirror finish surfaces. The high-mirror finish may be achieved by lapping.

The surface quality of the two rollers diminishes with each revolution of the rollers because a certain abrasion of metal occurs during each rolling process, whereby the surface of the rollers is contaminated. The mirror finish of the roller surface is intact only during the first revolution of the rollers. Thereafter, the surface quality diminishes from one revolution to the next, and with it the surface quality of the rolled pre-material. After a strip length of approximately 100 to 1.000 coin diameters has been worked, the rollers are usually dismantled and lapped to restore their high-mirror finish. In spite of this expensive procedure, the proofs obtained do not have a uniform, high surface quality.

Now, it is the object of the present invention to provide a way of producing a strip-like pre-material economically and with a uniform, high surface quality.

This object is achieved by a method having the features defined in Claim 1, and by a device having the features defined in Claim 63. Advantageous further improvements of the invention are the subject-matter of the dependant claims.

According to the invention, the metal strip is rolled always between the same two rollers, in two or more sections each shorter than the circumference of the rollers, for which purpose the metal strip is recalled between every two successive rolling steps, and the recalled section of the metal strip is rolled once again.

Recalling the metal strip allows the last rolling step to be carried out on each of the recalled sections of the metal strip between circumferential segments of the rollers which have not yet acted on the respective sections of the metal strip, during the one or more preceding rolling steps, so that the last rolling step takes place between circumferential segments of the two rollers that have the best surface quality still existing, whereas the preceding rolling steps can be carried out between circumferential segments of the two rollers which have been used before for a greater number of rolling steps and which already show a diminished surface quality. The surface quality of the strip-like pre-material finally produced is determined by the surface quality of those circumferential segments of the two rollers which perform the last rolling step on the metal strip section of interest.

Using a discontinuous multi-pass rolling process according to the invention, it is now possible to produce the strip-like pre-material with an especially high and uniform surface quality and with very low thickness tolerances, or to produce a pre-material with the quality known from the prior art in greater lengths than was heretofore possible, without having to exchange the rollers. There have already been achieved thickness tolerances of ±1 μm, repetitive accuracy values of ±2 μm, peak-to-value heights of only $R_1$=0.18 μm and centre line average heights (CLA) of only $R_1$=0.022 μm (DIN 4762).

In order to permit at least two rolling steps to be carried out on one section of the metal strip with the method according to the invention, the circumference of the rollers should be equal to at least twice the length of the recalled section, and the recalled section should be a little longer than the diameter of the proofs, in order to allow for the unavoidable stamping waste. If the metal strip is rolled not only in one direction, but alternately in the one and the other direction, as described in Claim 2, then one may chose to roll the metal strip several times between the same segments of the two rollers and to perform the last rolling step between two circumferential segments of the rollers which had been previously employed for a smaller number of rolling steps and which, therefore, still have a better surface quality so that they will give the metal strip a surface with equally optimum quality in the last rolling step.

If sections of the metal strip are rolled alternately in one and the other direction, one additionally achieves a more favourable material structure than would be obtained if the metal strip were rolled always in one and the same direction. This is even more important the more the thickness of the metal strip is reduced by the rolling process, because in the latter case material crowding caused by the rollers is also increased. Another advantage lies in the fact that the favourable effect on the metal structure, when rolling individual sections by a reciprocating process, is greater than when conventionally rolling a metal strip alternately in the one and the other direction over its full length.

Preferably, the roller diameter is selected so that at least ten, preferably at least fifteen proofs can be stamped from a section of the pre-material the length of which corresponds to the diameter of the rollers.

Step-by-step repeated rolling of the respective section of the metal strip is, preferably, carried out in such a way that of the surface segments of the two rollers that act on the respective section of the metal strip, those surface segments of the two rollers that act on the respective metal strip in the first pass carry out the greatest number of rolling passes, whereas the segments of the rollers that act on the respective section of the metal strip in the last pass carry out the smallest number of rolling passes, the surface quality being of course the best when the segment of the rollers that act on the metal strip in the last rolling pass is employed for a rolling step for the first time, i.e. still has an ideal high-mirror finish.

By carrying out a discontinuous multi-pass rolling process and by ensuring that the surface segment of the rollers that act son the material in the last rolling pass has the highest possible surface quality, while the surface of the pre-material was optimally prepared in the preceding rolling passes, the discontinuous multi-pass rolling process according to the invention permits a greater length of pre-material to be produced before the rollers have to be dismantled and their high-mirror finish has to be restored by lapping.

Thus, the method according to the invention also works more economically than the known method for producing proofs.

The number of rolling passes which act on the same section of the metal strip is adjusted to the desired reduction per pass and to the surface quality of the pre-material to be produced.

For carrying out the method according to the invention, a roll stand is suited which has a first coiler for the metal strip to be rolled arranged on the run-in end of the roll gap, and a second coiler for winding up the strip-like pre-material arranged on the run-out end of the roll gap, the coiler arranged on the run-in end of the roll gap being provided with a drive motor, especially a servomotor, for recalling the metal strip by steps of a predetermined length.

The length of the steps by which the metal strip is recalled may be adapted to the particular needs by an electronic drive control, especially in programme-controlled fashion. Such a programme control also permits the intermittent drive of the rollers, including forward rotation, stoppage and, if necessary, reverse rotation, to be optimally adapted to the particular rolling task.

An important advantage of the invention lies in the fact that it can be transferred to other applications. One such application relates to the production of metal strips with grooves, which instead of extending in longitudinal direction from the beginning to the end of the strip, extend crosswise over the full width of the metal strip, from one longitudinal edge to the other longitudinal edge of the strip, and which reoccur in intervals in the metal strip. Such grooved metal strips can be split and used for the production of parts, such as contact springs or commutator segments for electric motors, especially for servomotors. Modern servomotors are getting ever quicker and ever more precise. This places increasing demands on the accuracy to gauge of the commutator segments of such motors. The accuracy to gauge of the groove width should be better than 0.02 mm. If such a groove is to be produced in a metal strip by rolling, several passes will be necessary.

Conventionally, the grooves are produced in a metal strip by milling, but the surface quality achieved in this way is not very high. Milling grooves, which extend crosswise over the metal strip, is difficult. One has also tried to produce a longitudinally extending groove in a metal strip by several rolling passes. As a result of this process, lateral lands, delimiting the groove, remain in the metal strips on both sides of the groove. Given the fact that the metal strip is elongated in the area of the groove by a certain dimension, due to the displacement of material during the rolling process, but is not so elongated in the area of the lateral lands, the lateral lands must be correspondingly stretched in compensation, for example by the use of coilers that develop a correspondingly high tensile force. But even if the lateral lands are stretched, it is not possible to roll grooves the depth of which exceeds approximately 10% of the thickness of the metal strip. Moreover, the method is laborious and does not lead to the desired accuracy because the metal strip suffers a certain draught in each pass, with the result that the groove gets broader from one pass to the next, with increasing variations. The ways of proceeding described in DE-PS 104 875 and DE 197 04 300 A1 also do not permit high degrees of accuracy to gauge.

On the other hand, the method of rolling strips step by step and in sections according to the invention allows, generally, profiled metal strips which have the profile extending over the entire width of the metal strip to be rolled with both a high degree of accuracy to gauge and high surface quality, and this especially when the described multi-pass rolling method according to the invention is operated in such a way that, instead of rolling the metal strip in one direction and recalling it in the reverse direction, it is rolled in both directions, i.e. also in the recalling step.

The invention is particularly well-suited for rolling a regularly reoccurring profile intermittently in to a metal strip; such a metal strip can then be split to produce mutually identical mass parts, such as commutator segments or contact springs for electric purposes, with a high degree of accuracy. Splitting the strip is conveniently effected by stamping. The method according to the invention can be used with advantage also for coated strips. The coating is not removed by the rolling process, as is the case in the production of grooved strips by milling.

The accuracy and surface quality allowed by the method according to the invention are higher than the accuracy and surface quality achievable by milling, and also higher than achievable by the conventional method, where a longitudinally extending groove is produced in the metal strip by rolling over the full length which, due to the non-uniform elongation occurring in this case, is possible only up to reductions per pass of maximally 10%.

The intermittent operation of the method according to the invention contributes essentially to the accuracy to gauge of the profile of profiled metal strips. Due to the intermittent operation, each pass begins from the stopped condition of the metal strip and the rollers of the roll stand. In the initial phase of each pass, therefore, the elongation of the metal strip resulting from the engagement of the rollers in the metal strip does not begin abruptly, as is the case with continuous profile rolling methods, but sets in so smoothly that a constant tensile stress, which is important for the accuracy to gauge of the profile, can be maintained in the metal strip, for example by suitably controlling the drive of the coilers which serve to maintain the tensile stress. To this end, the rollers and the metal strip are accelerated and braked during the rolling process uniformly and synchronously.

If a profile is to be rolled into a metal strip by sections, the one roller may have a cylindrical shell and the other roller may have a profiled shell.

It is possible to roll a profile into the strip from the top and from the bottom. In this case, both rollers must be profiled. The accuracy to gauge and the surface quality will be the better the shorter the rolling passes are. Advantageously, the rolling passes are selected to be shorter than half the diameter of the rollers. In this case, the profile extends over only part of the circumference of the roller. The remaining part of the shell surface of the roller may be made cylindrical; it is then possible to use the cylindrical section of the roller surface in a first rolling pass for equalising, instead of profiling, the respective section of the metal strip in order to improve the accuracy to gauge of the rolled strip.

One application, for which the invention was realised with advantage for producing a strip-like pre-material, which is profiled in regularly reoccurring sections, relates to pens for fountain-pens.

Pens for fountain-pens have a thickness varying over their length. Typically, pens have a thickness of 0.2 mm in the rear region, with their thickness rising toward their point, where the pen finally reaches a thickness of maximally 0.6 mm. It is known to produce pens by rolling a metal strip by sections, i.e. by steps, the length of which corresponds to the length of the pens to be produced, so as to provide it initially with a corresponding longitudinal profile, which extends over the full width of the metal strip. This profiled metal strip serves as a pre-material from which the pens are then stamped out and thereafter formed to give them the desired bent shape.

To produce the profiled pre-material it has been known to give the upper roller of the two rollers, which define the roll gap and which are supported in a roll stand, an empirically determined contour in the circumferential direction, complementary to the intended thickness profile of the pens. Outside that complementary contour, the spacing of the outer surface of the roller from its axis is small enough to ensure that there will be no engagement with the metal strip in the roll gap in that area. At the beginning of the circumferential segment, which exhibits the complementary contour, the roller comes to cut into the metal strip, entraining it thereafter for the time of one rolling step, namely so long as it is in engagement with the metal strip, whereby the metal strip is both advanced and profiled. During this process, the metal strip is drawn off the first coiler, and the profiled metal strip exiting the roll gap is wound up by a second coiler. The motion of the metal strip being effected by the two rollers, a certain loop formation will necessarily occur between the rollers and the second, namely the winding-up coiler, which makes it necessary to provide a strip loop with a loop-tensioning device that balances out the intermittent strip transport by the rollers and the continuous winding-up action of the second coiler. This is connected with some apparatus input, which is a disadvantage.

Since the upper roller cuts into the metal strip to be rolled approximately 3 mm before the plane that intersects the longitudinal axes of the two rollers, it has further been conventional practice to pull back the metal strip by 1 to 2 mm using a pair of grippers synchronised with the rotation of the roller, before the upper roller cuts into the strip, so that the waste occurring when the pens are punched out later can be kept as small as possible.

Pens produced in the known manner exhibit undesirable variations in thickness. These are due to the fact, on the one hand, that the metal strip from which the pre-material is produced already exhibits variations in thickness, which get more noticeable in the pre-material produced by rolling, and this especially in the case of a high reduction per pass, with the additional negative aspect that a high reduction per pass is difficult to achieve with hard metal strips. Given the fact that a reduction per pass by 60% to 70% is required for the production of pens, the man skilled in the art is confronted with a serious problem in this case. The variations in thickness already existing in the initial material are typically in the order of ±0.02 mm. Additional variations in thickness are caused by the fact that in the case of the known methods for producing the pre-material the rollers revolve continuously and with uniform speed with the effect that cutting-in of the profiled roller and, thus, the feeding motion of the strip, set in and are later terminated abruptly. A uniform tensile force in the metal strip during the profiling process, which would be favourable for producing a uniform result with high accuracy to gauge, cannot be achieved with the known operating method.

In contrast, the present invention discloses a way of producing a profiled strip-like pre-material, for example for pens, with higher accuracy, i.e. with less deviation of the actual thickness profile from the intended thickness profile.

This is rendered possible by an improvement of the method according to the invention having the features defined in Claim 12, and a device having the features defined in Claim 44.

According to the invention, the metal strip is rolled in two or more rolling passes until the desired profile depth of the pre-material is obtained so that the entire deformation is reached by two or more reductions per pass, instead of one reduction per pass. However, this is not achieved by having the metal strip run through several roll stands arranged one behind the other; this would be by far too expensive, and the accuracy of positioning the metal strip longitudinally in the roll gap, which is required when a plurality of rolling steps are to be carried out on one and the same section of the metal strip, would be achieved either not at all or only with difficult. Instead, the metal strip is recalled between every two successive rolling passes, and the recalled section of the metal strip is rolled once again between the same two rollers. Only when the desired profile has been achieved in a section of the metal strip to be profiled, by one or more rolling passes and after one or more recalling steps, is the next strip section fed into the roll gap for profiling that next section of the metal strip.

However, it would likewise be possible to proceed in such a way that following the first rolling pass on a first strip section a similar first rolling pass is performed on the next following strip section, if necessary after having restored the initial position of the rollers, for example by reverse rotation of the rollers, and that the strip is then recalled by two steps, whereafter the second rolling pass is carried out first on the first strip section and then on the second strip section.

This improvement of the invention, which relates to the production of a profiled pre-material, offers essential advantages:

- By producing the profile of the metal strip not in one, but rather in two or more rolling passes, a higher accuracy to gauge is achieved than was heretofore possible, which is of significance, in the case of writing pens, especially in the area which later forms the shank.
- Since the desired profile is formed in one section of the metal strip not by one, but by two or more rolling passes, it is possible to profile even harder metal strips, including springy strips.
- This opens up applications of the invention that go beyond the field of writing pens and that cover a plurality of profiled parts that are formed from a strip-like semi-finished product and can be separated from the strip by punching. Such applications comprise, for example, electric conductive structures, such as contact springs, commutator segments for electric motors, further leadframes and chain links for watch straps and for bracelets.
- Due to the possibility to carry out the profiling operation by several rolling steps, the most complex profiles can be produced. It is even possible to roll the profile into the metal strip not only from one side, preferably from the top, but also from both sides. In this case, both rollers, defining the roll gap, can be provided with a corresponding contour which is not cylindrical in sections, and/or one of the rollers may be displaced during the rolling process in order to vary the gap height.

•The versatility of the invention is increased by the fact that the metal strip need not be profiled in each rolling pass, but may also be simply and uniformly reduced in thickness in a first rolling step, for which purpose the two rollers must have at least one cylindrical segment, if they are not anyway cylindrical. If the metal strip is profiled from one side only, then the other roller necessarily has a completely cylindrical surface.

•The progress realised by the invention is achieved with a minimum of apparatus input. Starting out from a roll stand known per se, one essentially only has to modify the operating procedure that leads to the desired profile. If one of the two rollers is profiled in the circumferential direction, as known per se in the production of writing pens, then it is modified for purposes of the invention in such a way as to give it successive segments of different contours in the circumferential direction, which segments are separated one from the other, especially by relieved sections, and in combination with the intended step of recalling the metal strip permit one and the same section of the metal strip to be repeatedly rolled. If profiling of the metal strip on both sides is desired, then the opposite roller may also be profiled in such a way as to give it likewise successive segments of different contours in the circumferential direction.

•However, there is also the possibility to make both rollers cylindrical and to achieve the variation in height of the roll gap, required for the profiling operation, during rolling by displacing one of the two rollers, preferably the upper roller, in the roll stand. This may be done, for example, with the aid of an electric motor driving two spindles, which act on the roller to be displaced and which are coupled to an incremental rotary transducer which permits recurring adjustments, and by means of which the electric motor can be controlled. Further, it is also possible to displace the upper roller hydraulically by acting with two short cylinders, having stroke lengths of, for example, 50 mm, on a crosshead of the roll stand and, via the crosshead, on the roller to be displaced. The piston rods of the two hydraulic cylinders are connected to incremental displacement pick-ups being part of a control circuit that controls the piston rods in accordance with predetermined values and/or of a predefined curve—depending on the profile to be rolled. Compared with the use of an electronic servo drive, a hydraulic servo drive provides the advantage to be quicker and more precise.

Such a servo drive for the displacement of one roller (the other roller serves as thrust roller) permits a profile to be rolled into the metal strip in one or more steps, even with cylindrical rollers. The way in which the roller has to be displacement in response to the strip transport depends on the desired profile. A corresponding control curve for the drive, derived from the profile to be rolled and intended to displace the rollers, may be stored as a control curve in a programmable electronic control unit. By storing a plurality of control curves, it is possible according to the invention to work a corresponding number of profiles in metal strips with a single roll stand and without any exchange of rollers.

If only one roller is displaced during the rolling operation, this, preferably, is the upper roller. Preferably, it is optionally possible to displace the upper or the lower roller during rolling in order to be able to roll a profile into the metal strip either from the top or from below. The respective other roller then serves as thrust roller, and its position remains unchanged.

Moreover, it is also possible to make use of the displacement of a roller during the rolling process in a roll stand having one profiled roller. This combination of two different possibilities of varying the height of the roll gap during the rolling process, namely by the use of a profiled roller in combination with the displacement of one roller, further increases the versatility of the roll stand in the production of strips that are profiled by sections.

If two cylindrical rollers are employed, it is of advantage if one of the rollers, especially the upper roller, is provided with a notch parallel to its axis, in order to have a reference for the angular position of the roller.

•In connection with the recalling step for the metal strip, the recalling device, for example the first coiler from which the metal strip is unwound, is of particular importance because it must be capable of reproducing with sufficient accuracy the length of the step by which the metal strip is recalled. To this end, the first coiler is, preferably, provided with a servomotor comprising an incremental rotary transducer which allows the desired step length to be precisely defined, both for the unwinding and for the coiling process.

The width of the metal strip may be selected to permit a single profiled part, for example a single profiled writing pen, to be punched out from each of the successively arranged strip sections. The economy of the process, and of the roll stand working according to the invention, can easily be multiplied if broader strips are profiled, which are wide enough to permit two or more writing pens or similarly profiled objects, lying one beside the other, to be formed from each profiled section of the pre-material.

A particularly advantageous improvement of the invention is defined in Claim 21.

According to that improvement of the invention, the metal strip is equalised before the profile is rolled. The term equalising is understood to mean that the metal strip is rolled in a roll stand with highly constant roll gap, whereby any variations in thickness of the metal strip are reduced. Roll stands for equalising are known from DE 25 41 402 C2, to which reference is made for further details. In the case of a known equalising roll stand a highly constant roll gap is achieved by the fact that pre-stress forces, acting vertically to the roller axes in a sense away from the material being rolled, are exerted on the roll necks, that extend outwardly beyond the roll neck bearings, which pre-stress forces may be oriented perpendicularly and may, preferably, act along a line of action that passes through the incoming metal strip and deviates from the plane of the roller axis by the rolling angle. This reduces the working play of the rollers in the roll neck bearings.

According to the invention it is, however, not intended to have the roll stand, which serves to profile the metal strip, preceded by an additional roll stand serving the equalisation process. Rather, the equalising and the profiling processes are carried out in one and the same roll stand, for which purpose the metal strip is moved through the roll gap in forward direction not only during the working steps that serve the profiling operation. Instead, the metal strip is first equalised by steps, being at least as long as the step for the profiling operation, with an only moderate reduction in thickness. Thereafter, the strip is recalled by a step of a length at least equal to the length required for the profiling operation and maximally equal to the length by which it has been advanced during the equalisation process, whereafter the profile is rolled into the recalled section of the metal strip. In a roll stand comprising a first cylindrical roller and a second profiled roller, where one circumferential segment has the contour adapted to the desired variation in thickness of, for example, a writing pen to be produced from the metal strip, the second roller is additionally provided for this purpose with a cylindrical circumferential segment separated from the circumferential segment that is provided with the contour (Claim 26). The cylindrical circumferential segment serves to carry out the equalising step. The length of the cylindrical circumferential segment is selected, depending on its function and giving due consideration to the elongation of the metal strip occurring during the rolling process, to ensure that the equalised section of the metal strip will at least have the length of the writing pen, or preferably a somewhat greater length, so that the beginning and/or the end of the profiling step can occur at a certain distance from the beginning and the end of the equalised section.

Consequently, according to the invention, the roll stand serving the profiling operation is simultaneously designed as equalising roll stand and is equipped with a strip feeding system by which the strip is moved by steps in forward and backward direction.

The improvement of the invention defined in Claim 21 and Claim 26 offers essential advantages:

- The variations in thickness of ±20 μm in the pre-material and, thus, in the writing pens to be produced can be reduced to less than ±2 μm in a particular pen, especially in the area of the pen that later serves as shank. A practically delivered device produced pens with variations in thickness of ±1 μm.
- The reproducibility of the thickness profile from one pen to the next initially reached ±4 μm. With the practically delivered device it was even possible to achieve a reproducibility of ±2 μm.
- These are accuracy values that could not be reached heretofore in the production of pens by rolling. Corresponding accuracy values can be reached also with strip-like pre-materials for other profiled products than pens.
- The great progress in accuracy is achieved with a minimum of apparatus input. Starting out from a roll stand known per se the profiling roll of the latter must be modified insofar as it must be provided with a suitable cylindrical segment, and the roll necks of the two rollers must be pre-stressed with a view to reducing the bearing play, for example in one of the ways disclosed in DE-25 41 402 C2. According to DE-25 41 402 C2, the roll necks of the two rollers are not pre-stressed directly, but indirectly by pre-stressing the roll necks of supporting rollers that pre-stress the two rollers, also known as working rolls. However, it is also possible to pre-stress the two (working) rollers directly. In addition, means are required that allow the metal strip to be not only advanced by steps, but also recalled by steps, the steps having approximately a length equal to the length of the equalising steps. As has been mentioned before, this can be achieved simply by providing the first coiler, form which the metal strip to be profiled is unwound, with an electric motor that can be controlled, with sufficient accuracy, in steps of the desired length and can be reversed in sense of rotation. This is realised, preferably, with the aid of a servomotor comprising an incremental rotary transducer that allows the desired step length to be exactly predetermined both for the coiling and for the uncoiling process. The servomotor is normally connected to a gearing arranged downstream. Whenever the term servomotor is used hereinafter, it is supposed that the servomotors are normally connected to a gearing arranged downstream.

Preferably, the second coiler, intended to coil the profiled metal strip, is also provided with such a servomotor.

- This has the additional advantage that a defined tensile force, which acts toward the achievement of a uniform pre-material with little variation in thickness, can be exerted on the metal strip, by the interaction of the servomotors in all phases, not only in the equalising step but also when profiling and recalling the metal strip. The tensile force should be as uniform as possible and should not drop below a certain basic tensile force which may be in the order of, for example, 500 N for the production of pens. When recalling the metal strip, the first coiler will, thus, pull the strip with greater force, compared with the smaller coiling force of the second coiler. By maintaining a basic tensile force in the metal strip, that remains as uniform as possible in all working phases of the metal strip, improved uniformly of the rolled pre-material is achieved and any off-centre running of the strip is avoided, which means that the metal strip will not get distorted.

Another advantage of driving the coilers by servomotors lies in the fact that the strip-feeding motion and the drive of the two rollers can be matched so precisely that, contrary to the prior art, the rollers can be driven discontinuously, instead of continuously. Specifically, it is then possible to adjust the speed at which the profiled rollers will cut into the metal strip so perfectly to the feeding speed of the strip that no abrupt acceleration of the metal strip will occur at the moment the roller cuts in. Specifically, cutting into the metal strip by the profiled roller may occur initially at a lower rate of strip feed and at low rotational speed of the roller, whereafter the rate of feed and the rotational speed of the roller may be increased. This is of particular advantage with respect to the achievement of small thickness tolerances.

- Another advantage of using servomotors for driving the coilers is seen in the fact that special strip-tensioning devices, as required in prior-art devices, are not longer necessary.
- A further advantage of using the servomotors for driving the coilers lies in the fact that using a programmable electronic control unit the strip feed can be adjusted very exactly to the length and the position of the profiled strip sections and to the rotation of the roller, preferably also to the vertical displacement of the roller, in order to vary the height of the roll gap if the latter is defined by two cylindrical roller surfaces or surface sections, and to thereby produce a particular profile.

Recalling the metal strip can be effected not only by a coiler arranged on the run-in end of the roll gap, but also by a recalling device designed as gripper feed mechanism. This embodiment of the invention is especially well-suited for working shorter or stiffer strips, especially for the production of a pre-material for proofs. When the recalling device is a gripper feed device, it may be used additionally to advantage the metal strip and to feed it into the roll gap.

Instead of using a coiler arranged on the run-out end of the roll gap, another gripper feed device may be used as pulling device for the strip exiting the roll gap during the rolling process. This embodiment of the invention is likewise mainly suited for working shorter or stiffer strips.

The quality of the strip-like pre-material produced is increased if a defined tension is maintained in the strip during both, rolling and recalling, that favourable influence being the greater the thinner the metal strip is. But it is of advantage also with thicker strips as used, for example, for the production of proofs, if the strip is kept under tension and is exactly guided between the recalling device and the pulling device by mutually matching the motion of the two devices, and this both during the rolling and the recalling steps.

The method according to the invention permits the optimum strip tension to be maintained in all phases of a rolling step, especially also in the critical phase when the profiled roller cuts into the metal strip, because the particular nature of the discontinuous multi-step rolling method according to the invention has the effect that each rolling step starts out from the stopped condition of the rollers and the metal strip so that the engagement of the profiled roller in the metal strip occurs not abruptly but rather so smoothly that the tensile force of the belt-tensioning device, for example the coilers, can be controlled to be maintained at a constant value optimally adapted to the respective strip in the critical phase when the profiled roller cuts into the metal strip and during the entire rolling step. For this purpose, the coilers and the rollers are, advantageously, accelerated and/or braked by their respective drive motors in synchronism and to the same degree when accelerating and braking the metal strip and the rollers.

The optimum pre-stress for removing the bearing play of the rollers can be determined empirically for the respective application and can then be kept constant for that application. Preferably, the process is optimised by determining the elongation of the roll stand occurring in the particular application during the equalisation process, and compensating it by suitable adjustment of the pre-stress.

However, equalising the metal strip can be carried out not only when producing a profiled pre-material but also when producing a non-profiled pre-material as used, for example, for proofs. In this case, the two rollers are anyway cylindrical and can be used for the equalising task in any position, provided the roll stand has a design, permitting the equalising process, by which the influence on the play of the roll necks in their bearings is reduced.

Further features and advantages of the invention will become apparent from the appended diagrammatic drawings showing certain embodiments of the invention in which.

Corresponding parts are identified in the examples by the same reference numerals.

Figure 1:
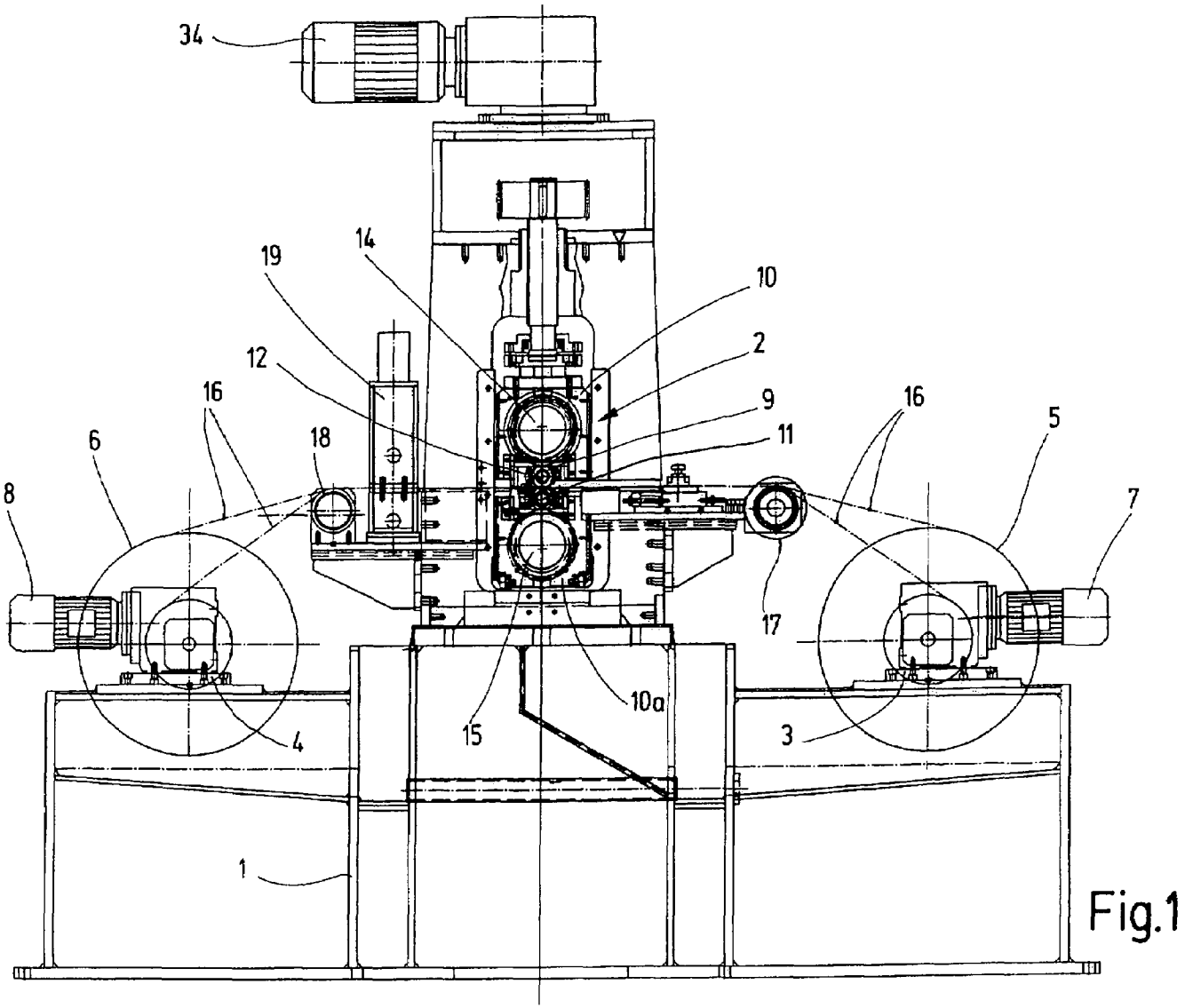
FIG. 1 shows a side view, sectioned in part, of a machine according to the invention.
Figure 2:
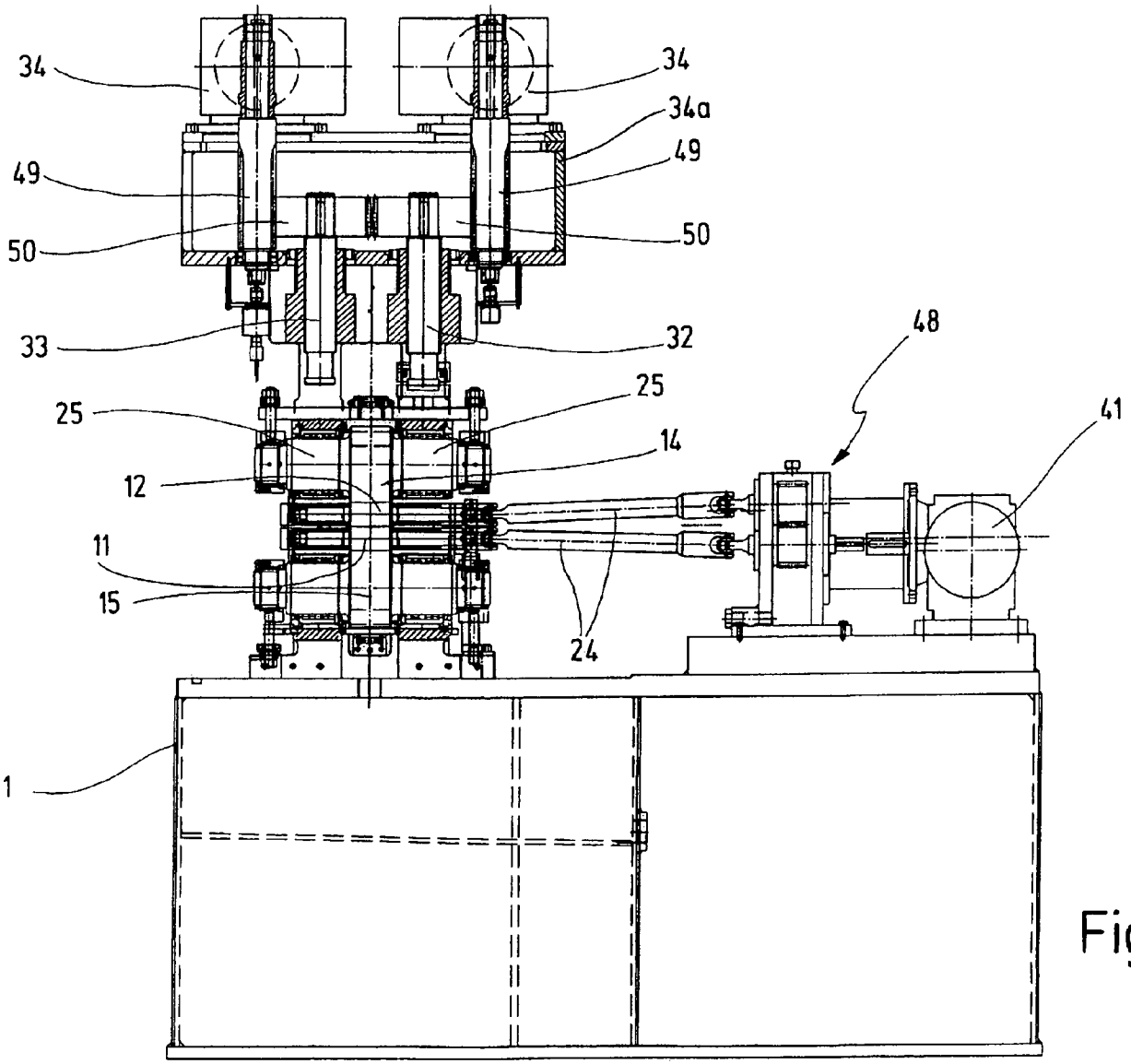
FIG. 2 shows a front view of the machine, sectioned in part.

The machine shown in FIGS. 1 and 2 comprises a machine bed 1 with a roll stand 2 erected in its middle and with one mounting device 3 and 4, respectively, for a coiler 5 and 6, respectively, mounted before and behind the roll stand, which coilers can be driven by a drive motor 7, 8 designed as electric servomotor.

Seated in lateral mounting elements 9 and 9*a* of the roll stand are two working rollers 11 and 12, hereinafter simply referred to as rollers, which coact to define a roll gap 13. Supporting rollers 14 and 15 of larger diameter are mounted in mounting elements 10 and 10*a*, respectively, above the upper roller 12 and below the lower roller 11. The mounting elements 9, 9*a* of the working rollers 11 and 12 are each arranged in a recessed portion of the mounting elements 10, 10*a* of the supporting rollers 14, 15. Two pairs of short hydraulic cylinders 46, 47, acting on the upper mounting element 9*a* and serving to compensate for any flexion of the working rollers 11, 12 during rolling, are arranged in the lower mounting element 9.

A metal strip 16 to be worked runs from the coiler 5 over a transfer roller 17 into the roll gap 13, passes the latter and reaches the second coiler 6, via a further transfer roller 18, where the metal strip 16, having been worked in the roll stand 2, is coiled up. Between the roll gap 13 and the second transfer roller 18, there is further provided a device 19 for exhausting rolling oil, in which the metal strip is cleaned from rolling oil.

Figure 3:
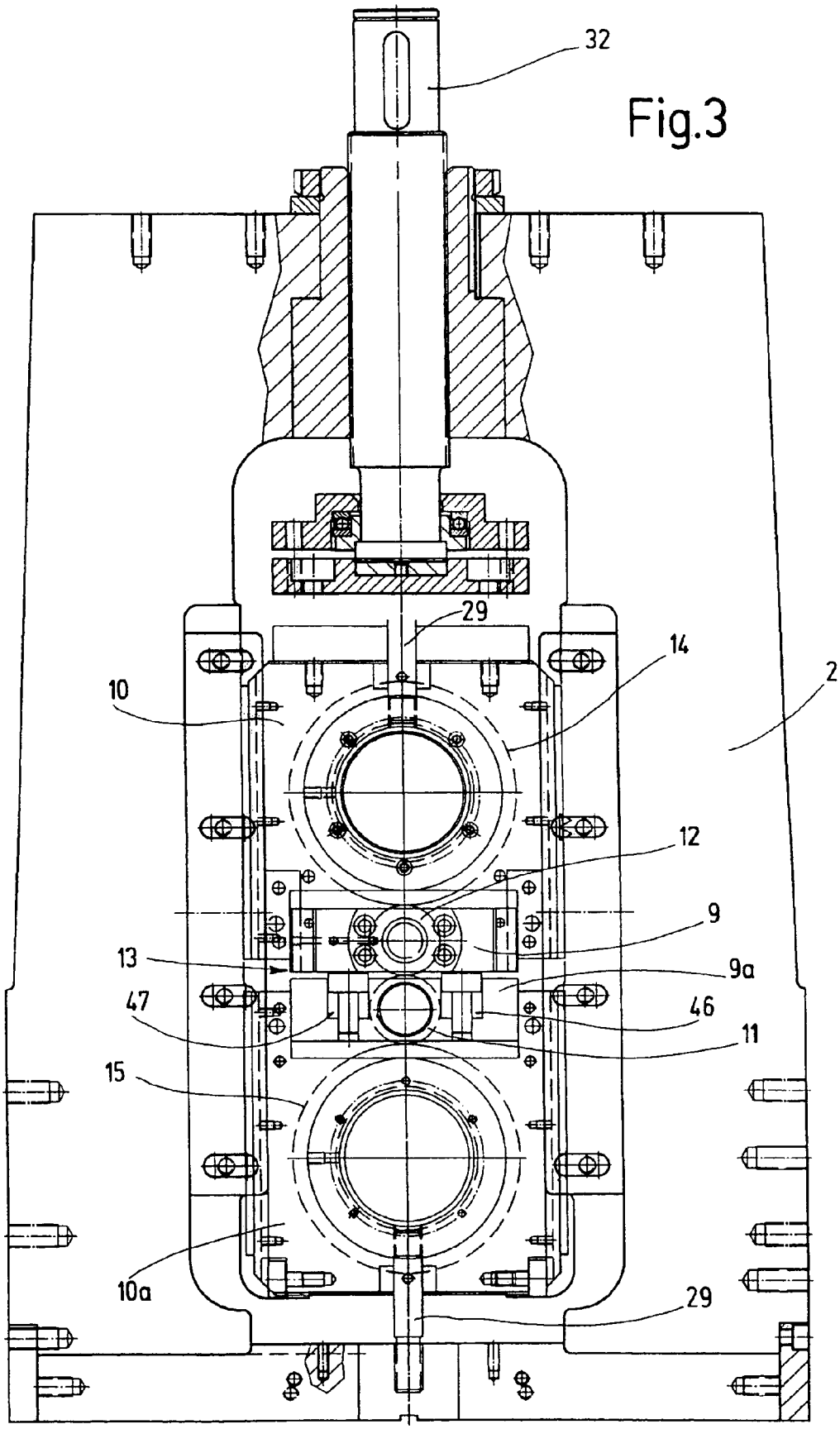
FIG. 3 shows a detail of the machine, namely the main part of the roll stand of the machine, in an enlarged scale compared with FIG. 1.
Figure 4:
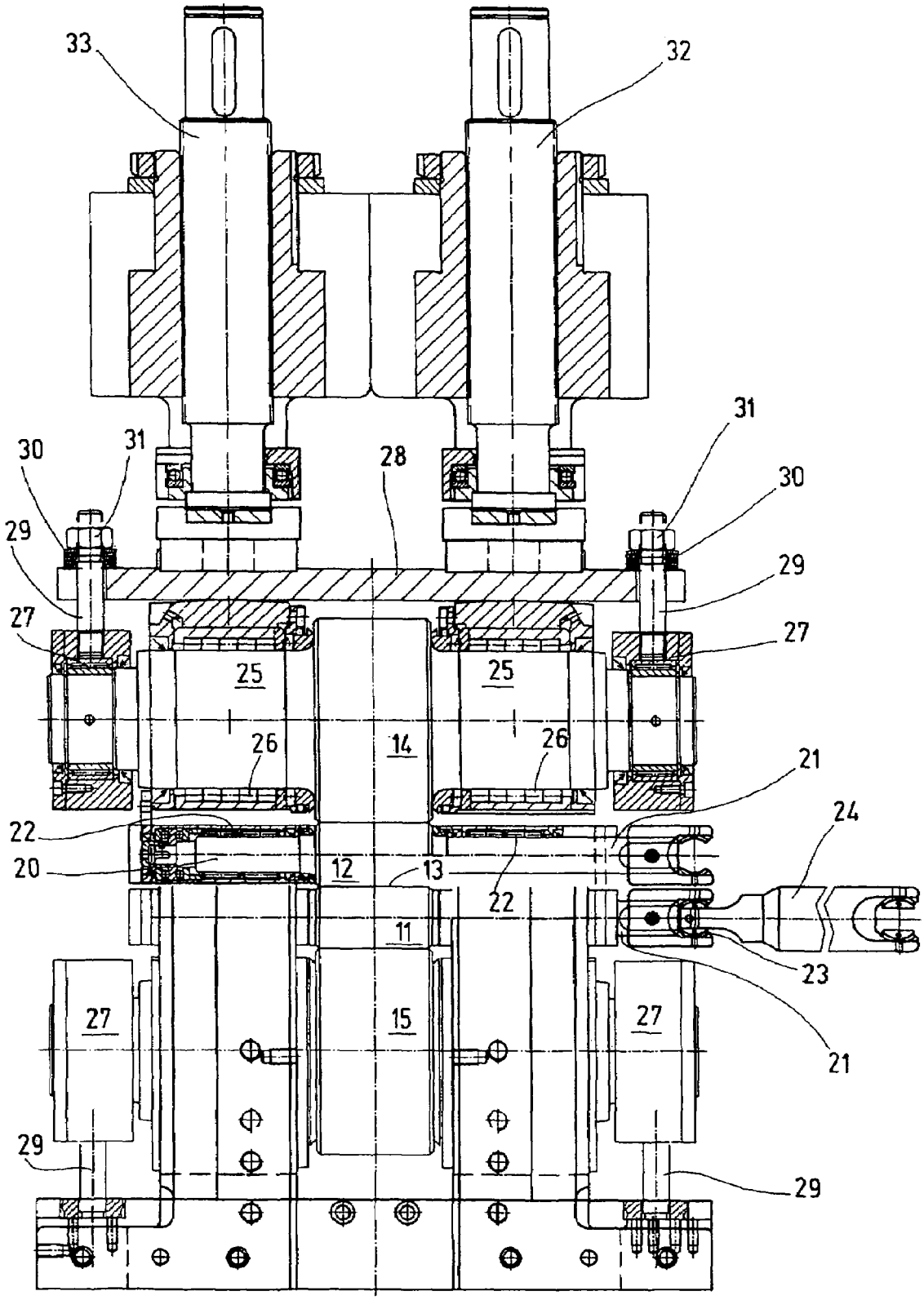
FIG. 4 shows a detail of the machine, namely the roll stand, in an enlarged scale compared with FIG. 2.

The structure of the roll stand 2 is shown more fully in FIGS. 3 and 4. There it can be seen that the two rollers 11 and 12, the diameter of which is only ⅓ of the diameter of the supporting rollers 14 and 15, are seated with their roll necks 20 and 21 in roll neck bearings 22 designed as roller bearings. One roll neck 21 of each of the two rollers 11 and 12 is extended beyond the respective roll neck bearing 22 and designed as part of a gimbal suspension 23, which allows each of the rollers 11 and 12 to be driven using a cardan shaft 24. An electric motor 41, driving the two rollers 11 and 12 in synchronism via the cardan shaft 24, is shown in FIG. 2. It drives the rollers 11 and 12 via a branching gearing 48, although it is likewise possible to have the rollers 11 and 12 driven by two separate motors, as will be discussed with reference to FIG. 17.

The supporting rollers 14 and 15 have roll necks 25 seated in roll neck bearings 26, designed as roller bearings, in the lateral mounting elements 10 and 10*a*. The roll necks 25 are extended beyond the roll neck bearings 26 and fitted in bushes 27, the bushes of the lower supporting roller bearing braced with the machine bed 1, whereas the bushes 27 of the upper supporting roller 15 are braced with a crosshead 28 arranged above it. Bracing is effected in each case using a threaded rod 29, projecting from the bushing 27, on which a set of cup springs 30 is tensioned by a nut 31. This is shown only above the crosshead 28, but the arrangement at the machine bed 1 is the same. The pre-stress so created reduces the bearing play of the supporting rollers 14 and 15 and, thus, its influence on the thickness deviations of the rolled metal strip, compared with the intended thickness. The rollers 11 and 12, just as the supporting rollers 14 and 15, thereby reach a degree of concentricity of ±1 μm.

The required pre-stress on the roll stand 2 is produced by means of two spindles 32 and 33, that press on the crosshead 28 and the bearing shells 27 from above and that are each driven by a separate electric motor 34 (see FIG. 1) arranged on top of the roll stand 2. Both electric motors 34 are provided for this purpose with a driving shaft 49, configured as pinion, whose teeth mate with a gear 50. The two gears 50 are fixed against rotation on the one spindle 32 and on the other spindle 33. The suitable pre-stress on the roll stand is determined empirically, based on the elongation of the roll stand in the particular application, and is adjusted so as to compensate for the elongation. After that preliminary adjustment, the machine according to the invention works as follows:

The metal strip 16 to be worked is drawn off the first coiler 5, passed through the roll gap 13, pulled to the second coiler 26 and fixed on the latter.

The first lower roller 11 has a cylindrical surface 11. The second upper roller 12 has a surface (FIG. 5) with a profiled circumferential segment 35 of a length L1, measured in the circumferential direction of the roller 12, and a cylindrical circumferential segment 35 of a length L2, measured in the circumferential direction of the roller 12, the two segments being separated by two relieved portions 37 and 38. The cylindrical circumferential segment 36 of the surface is spaced the largest distance from the axis of the second roller 12, the relieved portions 37 and 38 are spaced the smallest distance from the axis of the second roller 12. The profiled circumferential segment 35 of the surface has a contour the shape of which, viewed in the circumferential direction, is matched to the longitudinal development of the thickness of the writing pen finally produced from the metal strip 16.

In FIGS. 5 to 16, the first lower roller 11 of cylindrical shape is shown only in part.

Figure 5:
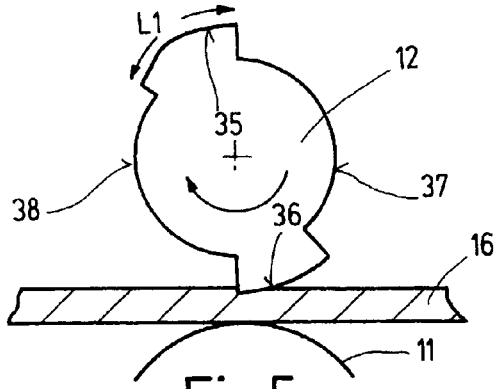
FIGS. 5-10 show a flow diagram of a first working method that can be carried out with the machine.
Figure 6:
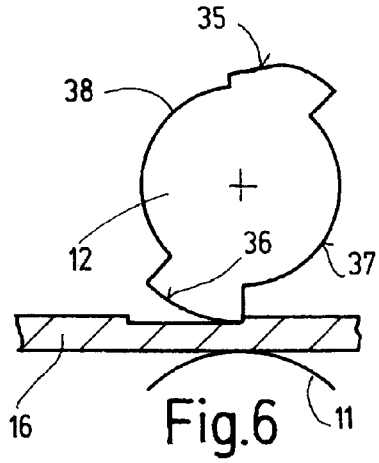
Figure 7:
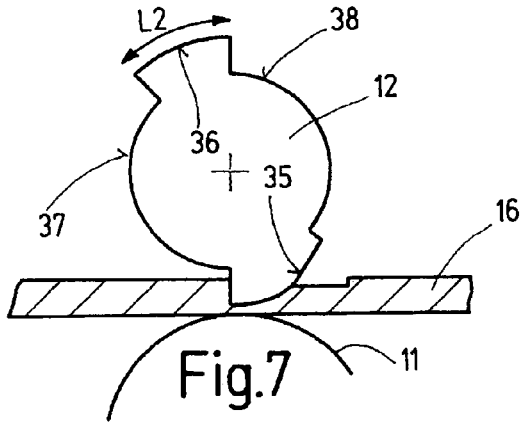
Figure 8:
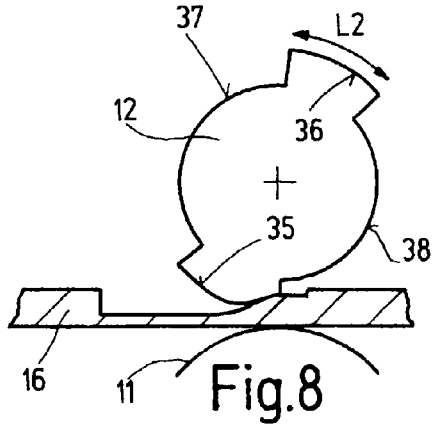
Figure 9:
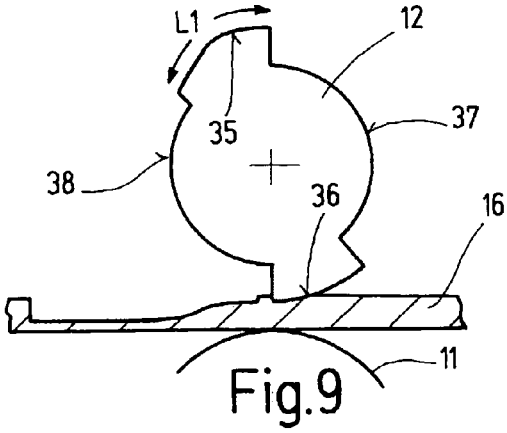
Figure 10:
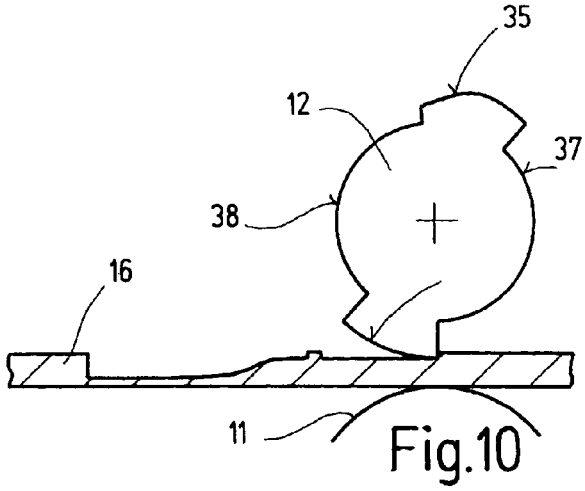

Working the metal strip 16 commences by causing the cylindrical circumferential segment 36 of the second roller 12 to cut into the metal strip stretched between the two coilers 5 and 6, and this smoothly at a low feeding speed of the metal strip 16 adapted to the circumferential speed of the cylindrical circumferential segment 36. The cutting-in phase is shown in FIG. 5, although not true to scale but with the metal strip 16 shown in exaggerated thickness. The further FIGS. 6 to 16 also show exaggerated reductions per pass, produced by the rolling process on the metal strip, in order to illustrate the rolling process more clearly. The cylindrical circumferential segment 36 rolls on the metal strip 16, thereby reducing the latter's thickness typically from 0.66 mm to 0.60 mm, while simultaneously equalising the thickness. The end of the equalising step is shown in FIG. 6. Now, the metal strip 36 gets out of engagement with the cylindrical circumferential segment 36 of the second roller 12, which continues to rotate over an additional small angle until the relieved portion 37 faces the metal strip 16. By reversing the two drive motors 7 and 8, designed as servomotors, the metal strip 16 is now recalled, preferably with the rollers 11 and 12 stopped, by a length greater than L1 but smaller than L2, L2 being the length over which the metal strip 16 had been equalised. The length by which the metal strip 16 is recalled is selected in such a way that in the next step (FIG. 7), when the movement of the rollers 11 and 12 and the feeding movement of the metal strip 16 are restarted, the profiled circumferential segment 35 of the roller 12, with the contour adapted to the writing pens, will smoothly cut into the equalised section of the metal strip 16 directly after its beginning (FIG. 7) or at a small distance, for example 2 mm, behind it. With the relieved portion 37 facing the metal strip 16, the spindles 32 and 33 are rotated to lower the upper second roller 12 far enough to ensure that the desired cutting depth will be reached with the profiled circumferential segment 35 of the roller 12, which is the next to cut into the metal strip 16. As the second roller 12 continues to rotate and the metal strip 16 is correspondingly advanced by the second coiler 6, the profiled circumferential segment 35 rolls the profile intended for the writing pen into the equalised section of the metal strip 16, over its entire width (FIGS. 7 and 8). FIG. 8 shows the final point of the profiling step. It ends a small distance before the end of the equalised section, at the latter's level. As the upper roller 12 continues to rotate, its relieved portion 38 faces the metal strip 16. In this phase, the upper roller 12 is returned to its upper position, by rotating the spindles 32 and 33, so as to adjust the height of the roll gap 13 as necessary for the following equalising step. The position of the relieved portion 38 between the profiled circumferential segment 35 and the cylindrical circumferential segment 36 of the second roller 12, and the action of position the metal strip 16 in the roll gap 13 by means of the servomotors 7 and 8 of the coilers 5 and 6, are matched in such a way that the next time the cylindrical circumferential segment 36 cuts into the material, this occurs at a small distance, approximately 2 mm, behind the end of the previously equalised section of the metal strip 16 (FIG. 9), whereby another equalising step is initiated, as shown in FIGS. 9 and 10.

During the equalising, profiling and recalling processes, the servomotors 8 and 9 ensure that the tensile stress in the metal strip 16 is kept as uniform as possible.

The practical embodiment shown in FIGS. 11 to 16 differs from the embodiment shown in FIGS. 5 to 10 in that the upper roller 12 acts on the metal strip 16 which is to be worked with three, instead of two, circumferential segments 35, 36 and 40, separated by relieved portions 37, 38 and 39. The roll stand 2 provided for this purpose has the same structure as the one shown in FIGS. 1 to 4, with the proviso that the roller 12 illustrated in FIGS. 11 to 16 is used as upper roller 12.

The circumferential segment 36 is cylindrical, whereas the two circumferential segments 35 and 40 have a non-cylindrical profile. Similar to the example shown in FIGS. 5 to 10, the cylindrical circumferential segment 36 has the largest spacing from the axis of the roller 12 over its full length, which is of advantage under the aspect that the cylindrical circumferential segment, which serves to carry out the equalising step, must be reground as necessary.

The working method illustrated in FIGS. 11 to 16 corresponds to the illustrated in FIGS. 5 to 10, with the exception that following the equalisation of the respective section of the metal strip 16, the profiling step is carried out in two successive, instead of one, rolling steps between which the metal strip is recalled once more.

Figure 11:
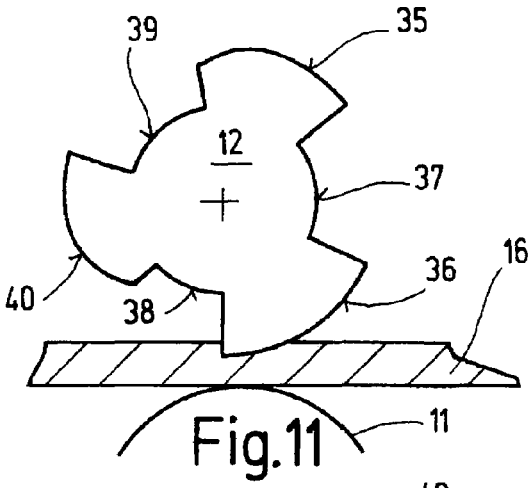
FIGS. 11-16 show a flow diagram of a second working method that can be carried out with the machine.
Figure 12:
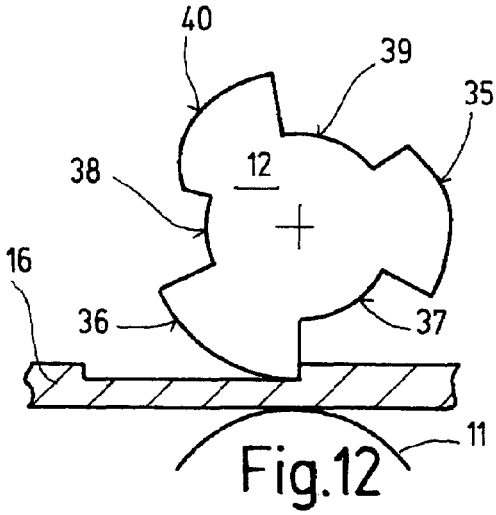
Figure 13:
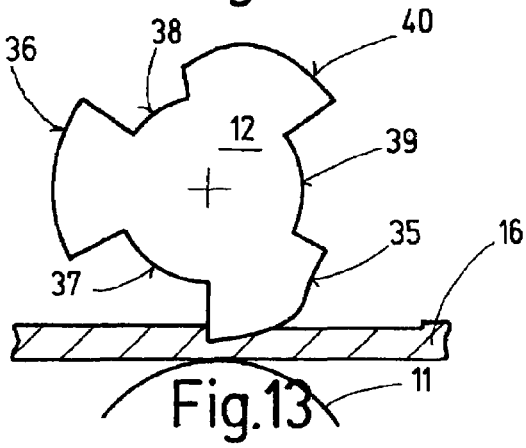
Figure 14:
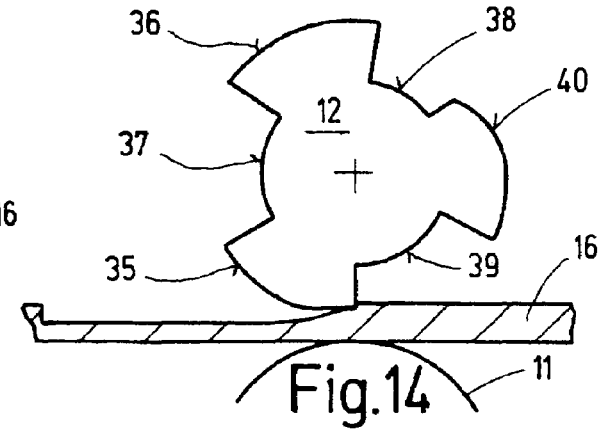
Figure 15:
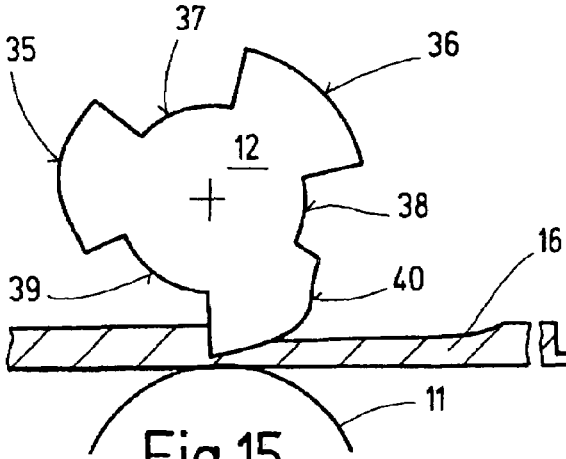

FIG. 11 shows, similar to FIG. 5, the moment when the cylindrical circumferential segment 36 of the roller 12 cuts into the metal strip 16. Similar to FIG. 6, FIG. 12 shows the end of the equalising step. By continued rotation of the upper roller 12, the metal strip 16 is brought out of engagement with the roller 12 and can be recalled by the coiler 5. During that phase, the upper roller 12 is lowered by means of the spindles 32 and 33 in order to adjust the height of the roll gap 13 for the subsequent first profiling pass, the beginning of which is illustrated in FIG. 13. FIG. 13 corresponds to FIG. 7 and shows the cutting-in phase for the first non-cylindrical, profiled circumferential segment 35 of the roller 12. FIG. 14 corresponds to FIG. 8 and shows the end of the first profiling step. As the roller 12 continues to rotate, the metal strip 16 is again brought out of engagement with the roller 12, and in this phase, with the relieved portion 39 facing the metal strip 16, the metal strip is recalled another time and the roller gap is adjusted, by operation of the spindles 32 and 33, for the second profiling step, the beginning of which is shown in FIG. 15 which illustrates the cutting-in phase of the profiled circumferential segment 40.

Figure 16:
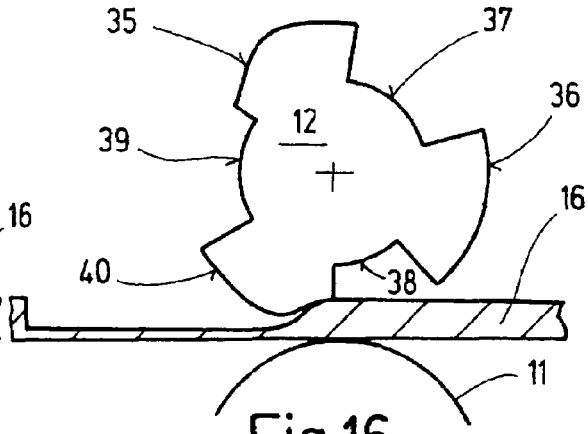

FIG. 16 shows the end of the second profiling step. By further rotating the roller 12, the metal strip 16 is once more disengaged and can be positioned for the equalising step in the next following strip section, which the height of the roll gap 13 is simultaneously adjusted for the equalising step. Thereafter, the sequence of steps illustrated in FIGS. 11 to 16 is repeated.

This method of operation is especially well-suited for the production of profiled sections in strips where the desired reduction per pass can be reached in a single profiling step with the desired accuracy either not at all or only with difficulty.

The invention may be carried out also with more than two profiling steps. In order to permit the required number of circumferential segments participating in the rolling process to be accommodated, the diameter of the roller 12 may be increased as desired.

Further, there is the possibility to provide, either additionally to or instead of an equalising step, a reducing step by which the thickness of the metal strip 16 is initially uniformly reduced in sections before these are profiled in a later rolling step.

There is further the possibility to give the metal strip 16 a profile on both sides, if required. In this case, the cylindrical roller used as lower roller 11 is replaced by a roller having, similar to the upper roller, one or more profited circumferential segments, in addition to one or more cylindrical circumferential segments, which additional segments are separated one from the other by relieved portions. When, as is preferred, the two rollers 11 and 12 can be driven separately, they can be used for the most diverse profiling tasks. If the rollers 11 and 12 are driven separately, it can always be ensured that one cylindrical circumferential segment of the one roller coacts during the rolling process with a randomly selected other circumferential segment of the opposite roller, independently of the sequence of circumferential segments chosen for the respective roller.

The invention finds its application not only in the production of pre-materials for pens, but also in the production of other pre-materials which are profiled, in a sequence of regularly reoccurring sections, over the entire width of the metal strip 16, for example for the production of a strip-like pre-material for the production of electric conductive structures, such as contact springs or leadframes, or for the production of grooved strips with the grooves extending crosswise to the longitudinal direction of the metal strip 16 and continuously from one longitudinal edge to the other longitudinal edge of the metal strip, for the production of, for example, commutator segments, electric plug-in connectors or other electric contact elements. The method according to the invention permits the production of any profiled shape that can be produced by means of—if necessary profiled—rollers.

Figure 17:
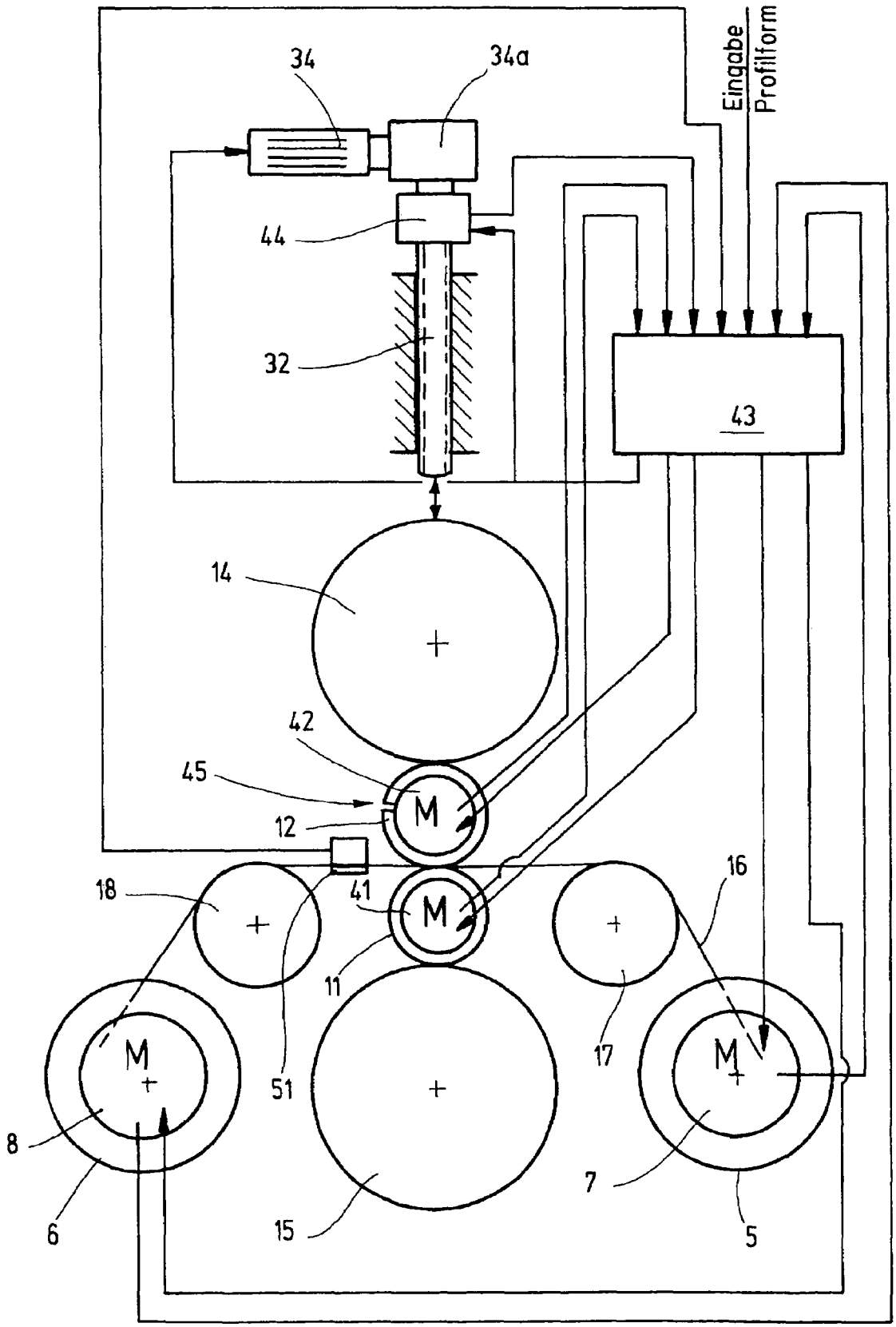
FIG. 17 shows a diagrammatic view of a method for carrying out the invention using two cylindrical rollers.
Figure 18:
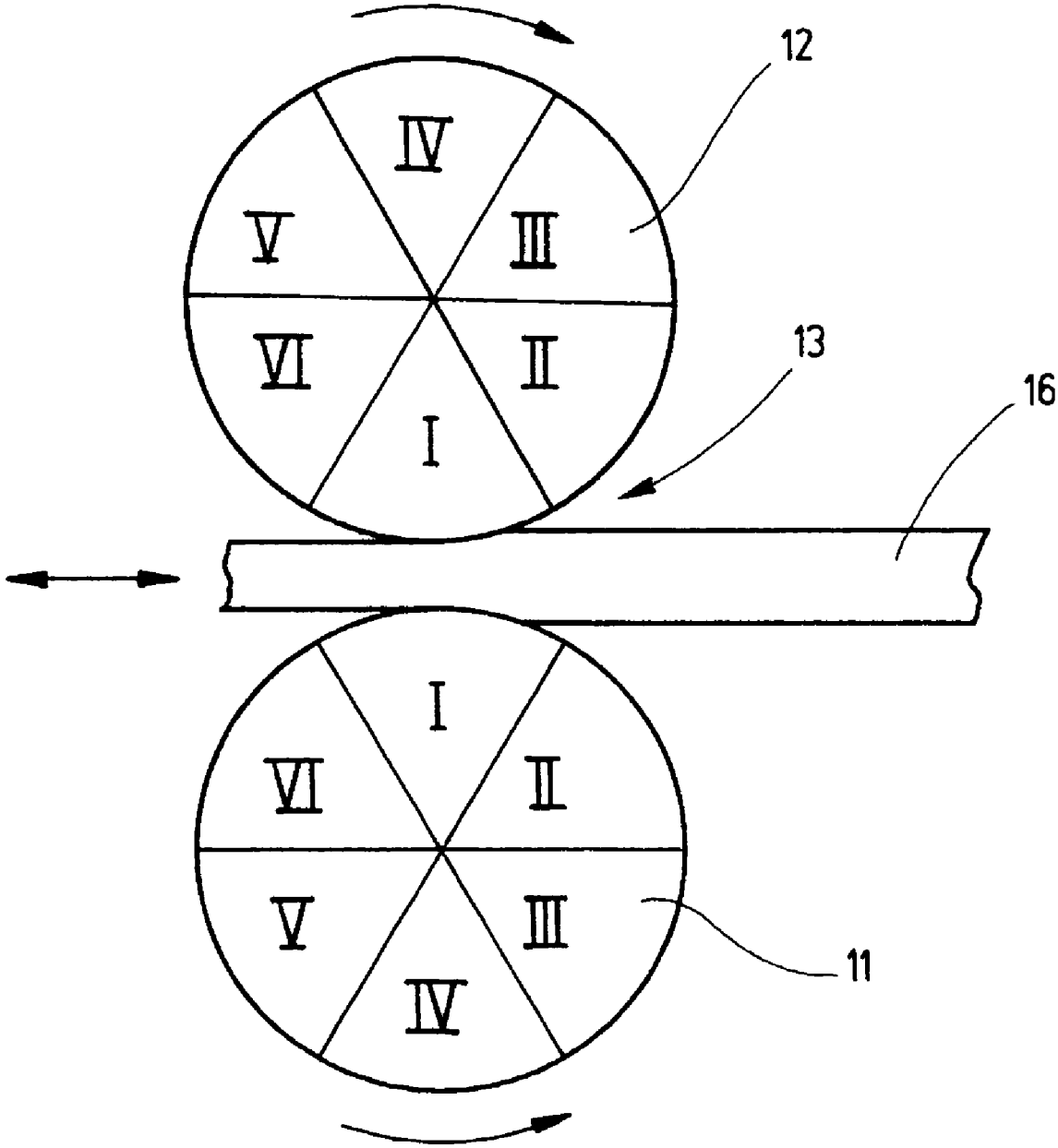
FIG. 18 shows two rollers, subdivided into six circumferential segments, illustrating a method for the production of a pre-material for proofs.

FIG. 17. shows, in a schematic diagram, however the servomotors 7 and 8 of the two coilers 5 and 6, preferably also electric motors 41 and 42 designed as servomotors for driving the two rollers 11 and 12, and the two electric motors 34, which preferably also consist of servomotors with a gearing 34*a* connected downstream, by which the upper rollers 12 can be displaced using the spindles 33 and 32, are linked via a common electric control unit 43. It is thus possible, by controlling the servomotors 7 and 8 in response to a profile shape to be rolled into the metal strip 16, which is input into the control unit 43 and, preferably, stored in digital form, to control the feeding motion of the metal strip 16 during rolling and recalling, to rotate, stop and, if necessary, reverse the rollers 11 and 12 correspondingly, and to displace the roller 12 by actuation of the electric motors 34, in response to the feeding motion of the metal strip 16 and the profile shape input to the control unit 43. To this end, the actual positions are each fed back to the control unit 43 by incremental rotary transducers. These rotary transducers are integrated in the servomotors, 7, 8, 41 and 42. In the drawing, one incremental rotary transducer 44 is shown by way of example between the spindles 32 and 33 and two servomotors 34, respectively.

FIG. 17 shows two cylindrical rollers 11 and 12, with the upper roller 12 having a radial notch 45 parallel to its axis in order to provide a reference for the rotary position of that roller 12. If the upper roller 12 has a non-cylindrical circumferential segment, as in the example previously discussed, displacing the upper roller 12 will not take place during the rolling process, but can be carried out only between the individual rolling steps, as necessary.

The curve according to which the displaceable roller 12 is displaced cannot only be stored in the control unit in the form of suitable software. Rather, a mechanical control using a cam running in synchronism with the strip feed is, generally, likewise possible.

The roll stand illustrated in FIG. 17 permits a pre-material for proofs to be produced with particularly high surface quality. Conveniently, the upper roller 12 is provided in this case with the radial notch, parallel to its axis, either not at all or not over its full length, but only at one of its edges, which is sufficient to gain an absolute reference for the rotational possible of the roller 12. Let it be assumed that the circumference of the rollers 11 and 12 is matched to the diameter of the proofs to be produced in such a way that six proofs can be punched out one after the other from a length of the pre-material corresponding to the circumference of the rollers 11 and 12. The roller surface is, therefore, subdivided into six equal circumferential segments I to VI. The method according to the invention can then be carried out, for example, as follows: At the beginning, the surfaces of the two rollers 11 and 12 exhibit a high-mirror finished produced by lapping. Let it be further assumed that each section of the metal strip 16 is finished-rolled in three rolling steps over a length corresponding to approximately ⅙ of the circumference of the rollers 11 and 12. This is done by rolling a first strip section between the circumferential segments I, opening the roll gap 13, recalling the metal strip 16 by the length of the section already rolled, rolling the strip again between the circumferential segment I, recalling it once again and finish-rolling it between the circumferential segments II.

The second section of the metal strip 16 is rolled in the first rolling step between the circumferential segments I, is then recalled, rolled in the second rolling step between the circumferential segments II, recalled and finish-rolled in the third rolling step between the circumferential segments III.

The third section of the metal strip 16 is rolled in the first rolling step between the circumferential segments II, is then recalled, rolled in the second rolling step between the circumferential segments III, recalled and finish-rolled in the third rolling step between the circumferential segments VI.

The fourth section of the metal strip 16 is rolled in the first rolling step between the circumferential segments III, is then recalled, rolled in the second rolling step between the circumferential segments IV, recalled and finish-rolled in the third rolling step between the circumferential segments V.

The fifth section of the metal strip 16 is rolled in the first rolling step between the circumferential segments IV, is then recalled, rolled in the second rolling step between the circumferential segments V, recalled and finish-rolled in the third rolling step between the circumferential segments VI.

This cycle may be repeated until the surface quality thereby achievable meets the demands placed on it. The number of cycles required to obtain the desired surface quality can be determined by preliminary tests. However, it is also possible to provide, between the roll gap 13 on the one side and the second coiler 6 on the other side, a thickness gauge for measuring the thickness of the metal strip 16 existing from the roll gap 13. Such a thickness gauge 51 is shown diagrammatically in FIG. 17 and in more concrete form in FIG. 19. The structure of the thickness gauge 51 is known as such. It may be a measuring gauge with mechanical probe with diamond pivot, the deflection of which is electrically tapped, or a unit measuring the strip thickness in no-contact fashion with the aid on X-rays, by measuring their weakening ratio as they are passed by the strip. Such a thickness gauge 51 may be part of a control circuit, as illustrated in FIG. 17, where it determines the actual value of the strip thickness, which is then input as input value to the electric control unit 43, which latter compares the actual value with the present nominal value for deriving therefrom an actuating signal for the two electric motors 34 which then effect a corresponding adjustment of the roll gap 13.

The device illustrated in FIG. 17 also permits metal strips with grooves that extend crosswise to their longitudinal direction, or metal strips with another profile extending continuously over the full width of the metal strip 16, to be produced if one of the two rollers 11, 12 is provided with a corresponding profile extending in the circumferential direction.

Figure 19:
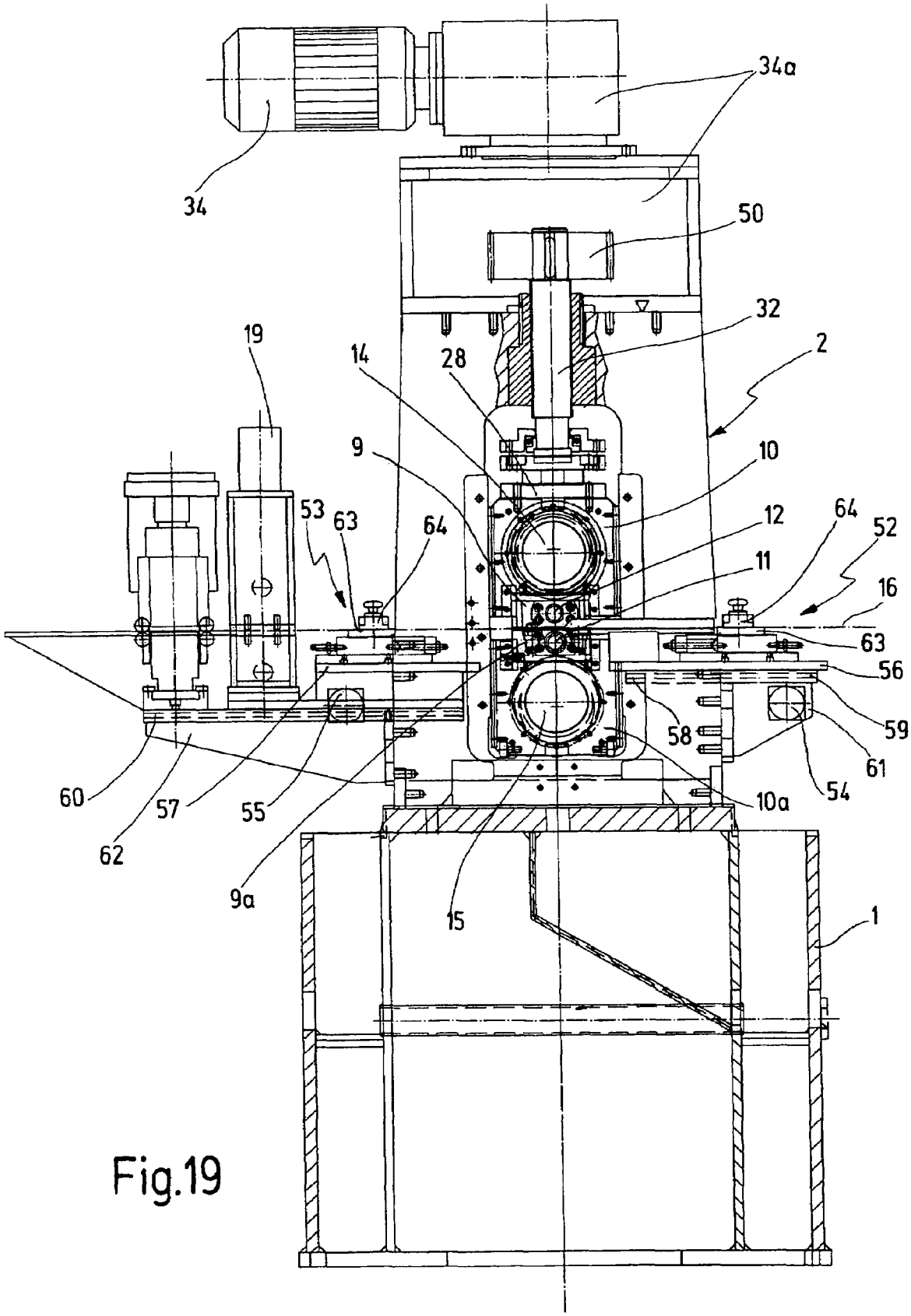
FIG. 19 shows a modified machine according to the invention, in a representation similar to FIG. 1.

FIG. 19 shows an embodiment modified as compared with FIGS. 1 to 4. It differs from the embodiments illustrated in FIGS. 1 to 4 insofar as gripper feed mechanisms 52 and 53 are provided instead of coilers 5 and 6. This embodiment is suited especially for shorter or thicker metal strips 16 that cannot be coiled so easily. This embodiment is suited in particular for the production of a pre-material for proofs in lengths of, for example, some meters.

The grippers feed devices 52 and 53 comprise a carriage 56, 67 that can be approached to and withdrawn from the roll gap 13 in horizontal direction, by means of a servomotor 54, 55. A dovetail spring 58 is provided for this purpose on the bottom surface of the carriage 56, 57, which spring engages a matching dovetail groove 59, 60 formed in an element 61, 62 attached to the roll stand 2. The engagement between the grooves 59, 60 and the spring 58 ensures perfect horizontal guidance for the carriages 56, 57. Other types of guides are also possible. Each carriage 56, 57 is equipped with a lower jaw 63 and an upper jaw 64, fixed rigidly on the carriage, the distance of the upper jaw from the lower jaw being variable, preferably by means of a pneumatic cylinder. The metal strip 16 is passed, and clamped if necessary, between the two jaw 63 and 64, which form a pair of grippers or a clamp. The gripper feed mechanisms 52 and 53 can be actuated and displaced individually, but also jointly in matched fashion. In the latter case it is also possible, during both the rolling and the recalling action, to maintain a defined tensile stress in the section of the metal strip that is tensioned between the two gripper feed mechanism 52 and 53.

The two gripper feed mechanisms 52 and 53 are arranged adjacent the roll gap 13, as shown in FIG. 19. The device 19 for exhausting rolling oil is arranged at the run-out end of the roll gap 13, following the gripper feed mechanism 53 in the rolling direction, followed by a thickness gauge 51 for picking up and signalling the thickness of the rolled metal strip 16, either by means of a probe or in no-contact fashion, so that suitable controlling or regulating action can be taken to vary the height of the roller 13 in a suitable manner if deviations from the desired thickness should occur.

LIST OF REFERENCE NUMERALS

1. Machine bed
2. Roll stand
3. Mounting device
4. Mounting device
5. Coiler
6. Coiler
7. Drive motor (servomotor)
8. Drive motor (servomotor)
9. Mounting element for working rollers
9*a*. Mounting element for working rollers.
10. Mounting element for supporting rollers
10*a*. Mounting element for supporting rollers
11. $1^{st}$ roller (working roller)
12. $2^{nd}$ (working roller)
13. Roll gap
14. Supporting roller
15. Supporting roller
16. Metal strip
17. Loop-tensioning roll
18. Loop-tensioning roll
19. Exhaust device for rolling oil
20. Roller neck
21. Roller neck
22. Roller neck bearing (roller bearing)
23. Gimbal suspension
24. Cardan shaft
25. Roller neck
26. Roller neck bearing (roller bearing)
27. Roller surface
28. Crosshead
29. Threaded rod
30. Cup springs
31. Nut
32. Spindle
33. Spindle
34. Electric motor
34*a*. Downstream gearing
35. Profiled circumferential segment
36. Cylindrical circumferential segment
37. Relieved section
38. Relieved section
39. Relieved section
40. Profiled circumferential segment
41. Electric motors
42. Electric motors
43. Electronic control unit
44. Rotary transducer
45. Notch
46. Hydraulic cylinder
47. Hydraulic cylinder
48. Gearing
49. Shaft
50. Toothed gear
51. Thickness gauge
52. Gripper feed mechanism
53. Gripper feed mechanism
54. Motor for 52
55. Motor for 53
56. Carriage
57. Carriage
58. Spring
59. Groove
60. Groove
61. Attached element
62. Attached element

63. Lower jaw

64. Upper jaw

The invention claimed is:

1. Method for producing a strip-like pre-material from metal by means of rollers of a roll stand, which define a roll gap, by rolling a metal strip in at least two rolling steps, characterised in that a profile is rolled discontinuously into the metal strip in successive steps between the same two rollers said method comprising (a) rolling a section of the metal strip in a first step (b) recalling the metal strip by a length which is selected to be shorter than the circumference of the rollers and (c) rolling the metal strip at least one again in a subsequent step within the section of the strip which has been rolled in the preceding step, and (d) rolling a subsequent section of the metal strip by performing steps (a) to (c) in said subsequent section, the profile extending over the full width of the metal strip and having a metal-strip thickness varying over the length of the metal strip, whereby said metal strip is divided into a series of sections, each of which is rolled at least twice before a subsequent section is rolled.

2. The method as defined in claim 1, characterised in that the metal strip is rolled also during the recalling step.

3. The method as defined in claim 1, characterised in that the recalled length of the metal strip is selected to be maximally equal to half the circumference of the rollers.

4. The method as defined in claim 1, characterised in that the two rollers are selected to have a cylindrical shape.

5. The method as defined in claim 1, characterised in that the last rolling step in each of the recalled sections of the metal strip is carried out between circumferential segments of the two rollers that have not yet acted on the respective section of the metal strip in the one or more preceding rolling steps.

6. The method as described in claim 5, characterised in that step-by-step repeated rolling of the respective section of the metal strip is carried out in such a way that of the circumferential segments of the two rollers that act on the respective section of the metal strip, the circumferential segment of the two rollers that acts on the respective section of the metal strip in the first step has carried out the greatest number of rolling steps, and the circumferential segment of the rollers that acts on the respective section of the metal strip in the last rolling step has carried out the smallest number of rolling steps.

7. The method as defined in claim 6, characterised in that the smallest number is selected to be zero.

8. The method as defined in claim 5, 6 or 7, characterised in that the shell surface of the two rollers is reworked to restore the original surface quality when a predetermined number of rolling steps has been reached by those circumferential segments with which the smallest number of rolling steps has been carried out.

9. The method as defined in claim 8, characterised in that the predetermined number of rolling steps is adjusted to the desired surface quality of the strip-like pre-material.

10. The method as defined in claim 1, characterised in that by rolling the metal strip it is simultaneously equalised.

11. The method as defined in claim 1, characterised in that the rollers and the metal strip are accelerated and braked in the respective rolling steps in synchronism and to the same degree.

12. The method as defined in claim 1, characterised in that for producing a strip-like pre-material with a profile recurring in successive sections of the pre-material, a roll stand is used which permits the height of the roll gap to be varied, and that the sections of the metal strip to be profiled are passed through the roll gap in recurring steps of predetermined lengths until the depth of the desired profile of the pre-material has been reached in the respective section of the metal strip.

13. The method as defined in claim 1 or 12, characterised in that a profile is rolled into the recalled section of the metal strip in two or more than two rolling steps.

14. The method as defined in claim 1 or 12, characterised in that the profile is rolled into the metal strip from above.

15. The method as defined in claim 1 or 12, characterised in that the profile is rolled into the metal strip from below.

16. The method as defined in claim 1 or 12, characterised in that a profile is rolled into the metal strip from above and from below.

17. The method as defined in claim 12, characterised in that a relieved portion is provided in the shell surface of the rollers, between circumferential segments effective during the rolling process, which relieved portion extends over a circumferential angle such that the next following circumferential segment to become active during the rolling process will cut into the metal strip only after the preceding circumferential segment of the metal strip, active during the rolling process, has released the metal strip.

18. The method as defined in claim 1, characterised in that the metal strip is merely reduced in thickness, but not yet profiled, in a first rolling step.

19. The method as defined in claim 18, characterised in that the reducing step is followed by one or more profiling steps between the same two rollers.

20. The method as defined in claim 18, characterised in that the length of the reducing step is greater than the lineal length of the next following profiling step.

21. The method as defined in claim 18, characterised in that the metal strip is recalled, following the reducing step, by a lineal length smaller than the lineal length of the reducing step and greater than the lineal length of the next following profiling step in the same section of the metal strip.

22. The method as defined in claim 18, characterized in that the metal strip is equalised in the first rolling step.

23. The method as defined in claim 1, characterised by the use of a roll stand in which at least one of the two rollers comprises in its shell surface a profile segment with a contour which, in combination with the contour of the other roller, defines the roll gap.

24. The method as defined in claim 23, characterised in that prior to rolling a profile, the metal strip is first equalised in the roll gap between the same rollers in steps of a lineal length not smaller than the lineal length of the first profiling step, with moderate reduction in thickness, is then recalled by a step equal to at least the lineal length of the first profiling step and maximally equal to the second lineal length, whereafter the profile is rolled into the recalled section of the metal strip, and that the rollers for equalising the metal strip comprise on their shell surface a cylindrical circumferential segment which is separated, if necessary, from the profiled circumferential segments that exhibit a non-cylindrical contour.

25. The method as defined in claim 10 or 23, characterised in that the thickness of the metal strip is reduced during the equalising step by a dimension in the order of one tenth of the thickness.

26. The method as defined in claim 1, characterised in that one roller of the roll stand is displaced during the rolling process of the metal strip for varying the height of the roll gap.

27. The method as defined in claim 26, characterised in that the upper or the lower roller are selectively displaced during the rolling process.

28. The method as defined in claim 26, characterised in that the respective roller is displayed by means of a servo drive.

29. The method as defined in claim 28, characterised in that one or two electric motors or one or two short hydraulic cylinders are used for the servo drive.

30. The method as defined in claim 26, characterised in that the displacement of the roller is effected by means of a programme-controlled drive, the profile to be produced in the respective rolling step being stored in a program-controllable control unit as control curve for the drive which effects the displacement of the roller.

31. The method of defined in claim 26, characterised in that one of the rollers, specifically the upper roller, has a notch parallel to its axis.

32. The method as defined in claim 1, characterised in that the two rollers are driven step by step and in synchronism with the feeding motion of the metal strip.

33. The method as defined in claim 1, characterised in that the two rollers are differently rotated during the recalling action of the metal strip.

34. The method as defined in claim 1, characterised in that the metal strip to be rolled is unwound from a first coiler and the rolled metal strip is wound up on a second coiler, and that the rotation speed of the rollers and the circumferential speed of the second coiler are mutually matched, especially in the phase when the rollers cut into the metal strip.

35. The method as defined in claim 1, characterised in that cutting-in by a roller is effected at reduced rotational speed of the roller and, correspondingly, reduced feeding speed of the metal strip and that the movements are then accelerated.

36. The method as defined in claim 1, characterised in that the metal strip is recalled using a first pair of grippers.

37. The method as defined in claim 36, characterised in that the metal strip is advanced by the first pair of grippers also for rolling.

38. The method as defined in claim 36, characterised in that the metal strip is pulled, during rolling, by a second pair of grippers engaging that section of the metal strip that exits from the roll gap.

39. The method as defined in claim 1, characterised in that a tensile strength is constantly maintained in the metal strip, during rolling just as during the recalling action.

40. The method as defined in claim 1, characterised in that the width of the metal strip is selected in such a way that two or more than two objects, that are intended to be punched out from the pre-material formed by rolling, can be punched out one beside the other.

41. A device having a roll stand with two rollers that define a roll gap the height of which can be varied, and with a recalling device for a metal strip to be rolled, arranged on the run-in end of the roll gap, for producing a strip-like pre-material from metal, with a profile which recurs in successive sections of the pre-material, according to the method defined in claim 1, for which purpose the first and/or the second roller are provided on their shell surface with two or more than two circumferential segments, following each other in the circumferential direction, which are not all of them equal in contour, and for which purpose a drive motor is provided for the recalling device arranged on the run-in end of the roll gap, for recalling the metal strip by steps of predeterminable length.

42. The device as defined in claim 41, wherein the recalling device is a first coiler.

43. The device as defined in claim 41, wherein the recalling device is a gripper feed mechanism.

44. The device as defined in claim 41, wherein a pulling device for the strip-like pre-material is provided on the run-out end of the roll gap.

45. The device as defined in claim 44, wherein the pulling device is a second coiler for winding up the strip-like pre-material.

46. The device as defined in claim 44, wherein the pulling device is a second gripper feed mechanism.

47. The device as defined in claim 41, wherein the two rollers can be driven on independently from the other.

48. The device as defined in claim 41, wherein at least one roller has a cylindrical circumferential segment.

49. The method as defined in claim 48, wherein both rollers have a cylindrical circumferential segment.

50. The device as defined in claim 48, wherein one of the rollers is displaceable and has a notch parallel to its axis.

51. The device as defined in claim 41, wherein the roll stand is designed as equalising rolling mill.

52. The device as defined in claim 41, wherein the drive motor for the recalling device provided on the run-in end of the roll gap is an electric servomotor.

53. The device as defined in claim 41 wherein the pulling device provided on the run-out end of the roll gap is driven by an electric servomotor.

54. The device as defined in claim 41, wherein the two rollers are each loaded on their side facing away from the roll gap by one supporting roller whose roll necks are pre-stressed in their roll neck bearings for reducing their bearing play.

55. The device as defined in claim 41, wherein the first roller and the second roller are not loaded by supporting rollers, but rather the roll necks of the first roller and of the second roller are pre-stressed in their roller neck bearings for reducing their bearing play.

56. The device as defined in claim 41, wherein the first and the second rollers are discontinuously driven in a manner such that they are driven, during the strip feed, in synchronism with the pulling device provided on the run-out end of the roll gap, whereas they are temporarily stopped and/or positioned individually or jointly by forward or reverse rotation when the recalling device provided on the run-in end of the roll gap is driven in the reverse sense for recalling the metal strip.

57. The device as defined in claim 41, wherein the circumferential speed of the two rollers and the speed of the pulling device preferably also the speed of the recalling device can be controlled in arbitrary fashion.

58. The device as defined in claim 41, wherein one of the two rollers, preferably the upper roller, can be moved up and down in controlled fashion during the rolling process.

59. The device as defined in claim 58, wherein the one or the other roller can be selectively moved up and down in controlled fashion during the rolling process.

60. The device as defined in claim 58 or 59, wherein one or more servo drives are provided for effecting the displacement of the respective roller.

61. The device as defined in claim 60, wherein the servo drives comprise one electric motor or one or two short hydraulic cylinders each.

62. The device as defined in claim 58, wherein an electric control unit is provided in which the displacement of the one roller required for an intended profile is, stored as curve and wherein the servomotors of the recalling device and of the pulling device, one or two servomotors for rotating the two rollers, and one or more actuating drives for the displaceable roller coupled with an incremental rotary transducer, are connected to said control unit.

63. The device as defined in claim 41, or 62, wherein the sense of rotation of the two rollers can be reversed for rolling in both directions.

* * * * *